United States Patent [19]

Tesch et al.

[11] 4,413,030

[45] Nov. 1, 1983

[54] FIBER AGGREGATE

[75] Inventors: Günter Tesch, Fribourg; Siegfried Gieldanowski, Schmitten, both of Switzerland

[73] Assignee: Breveteam S.A., Fribourg, Switzerland

[21] Appl. No.: 266,921

[22] Filed: May 26, 1981

Related U.S. Application Data

[63] Continuation of Ser. No. 109,304, Jan. 3, 1980, abandoned.

[30] Foreign Application Priority Data

Jan. 9, 1979 [CH] Switzerland ..... 157/79

[51] Int. Cl.[3] ..... B32B 3/02

[52] U.S. Cl. ..... 428/85; 422/96; 422/218; 422/220; 422/222; 422/227; 422/297; 422/299; 422/300; 422/301

[58] Field of Search ..... 428/37, 85, 96, 218, 428/220, 222, 297, 300, 369, 370, 371, 299, 301, 227

[56] References Cited

U.S. PATENT DOCUMENTS

| | | | |
|---|---|---|---|
| 3,679,536 | 7/1972 | Kalwartes | 428/131 |
| 3,681,182 | 8/1972 | Kalwartes | 428/131 |
| 3,681,183 | 8/1972 | Kalwartes | 428/131 |
| 3,682,756 | 8/1972 | Kalwartes | 428/359 |
| 3,950,587 | 4/1976 | Colijn et al. | 428/300 |

FOREIGN PATENT DOCUMENTS

| | | |
|---|---|---|
| 2811004 | 9/1978 | Fed. Rep. of Germany . |

*Primary Examiner*—James J. Bell
*Attorney, Agent, or Firm*—Ernest F. Marmorek

[57] ABSTRACT

A fiber aggregate is composed of a multiplicity of substantially spherically intermingled fibres at a needle-processing density. The fiber aggregate has a diameter of at least 3 mm, and the fibers have a length of at least 15 mm, and are free from being felted and intertwined with any other fiber.

13 Claims, 9 Drawing Figures

FIBER AGGREGATE

This is a continuation, of application Ser. No. 109,304, filed on Jan. 3, 1980 now abandoned.

Reference should be had to the application Ser. No. 109,302 entitled "Textile Material" filed by Günter Tesch et al. on Jan. 3, 1980, and assigned to the same assignee.

BACKGROUND OF THE INVENTION

Fiber aggregates of the kind described in the abstract of the disclosure are already known from German patent DE-OS 28 11 004, which consists of nodules of interlocked short fibers or fiber pieces, and which fiber aggregates are suitable as a sealing material or padding material. In order to obtain an adequate interlocking or felting of fibers, it is therefore undesirable that any large number of fiber pieces accumulate. As is known, however, interlocked fibers represent an irregular mass, which is difficult to disentangle or unravel, or an irregular mixture of fibers in crossed positions occurring at a high density, from about 0.1 g/cm$^3$, to, for example, about 0.6 g/cm$^3$ (Jaumann, Neues grosses Handbuch der Textilkunde, Fachbuchverlag Dr. Pfannenberg & Co., Giessen, 1956, second edition, pages 689 to 693, and Handbuch für Textilingenieure and Textilpraktiker, Fachteil T 14, E. Wagner, Mechanisch-Technologische Textilprüfungen, Dr. Spohr-Verlag, Wupperthal-Elberfeld, 1966, eighth edition, page 293). Products made from interlocked fibers also feel heavy to the grip (Fischer-Bobsin, Lexikon Textilveredlung und Grenzgebiete, Verlag Fischer-Bobsin, Dülmen-Daldrup, 1960, second edition, pages 694 to 695). The known fiber nodules may be only attached to one another by binding means, or through another material, for example, by being attached to a carrier. Particularly due to their short fiber length of about 3 mm, and their dense structure, the use of these fiber nodules is therefore rather limited. The fiber modules cannot be used for textile materials, when products of relatively low hardness and low density are desired, or if further processing of such materials is required, based on the structure of such materials, and without the use of any binding means, for example, for the fabrication of substantially flat textile materials.

There are further known (from German Patent De-12 83 084, or French Patent FR 14 22 835, German Patent DE-AS 15 61 625, or Belgian Patent BE 682.175), ball-shaped fiber aggregates, which have a diameter of about 5 mm, in which wooden fibers are merely laid next to one another, and which are manufactured, while they are suspended in a watery liquid, so as to avoid that they are dissolved or decomposed as a result of a turbulence acting thereon for several hours. The fiber balls separated from the watery liquid and dried thereafter have a density of about 0.02 to 1 g/cm$^3$, and correspond in their size strictly to the length of the fibers, which varies from about 0.2 mm to about 15 mm. As the size of the ball-shaped yarn is dependent on the respective fiber length, building up of the ball-shaped yarn from fibers disposed next to one another is therefore dependent on, and limited to, the use of selected fiber materials. Fibrous aggregates of this type are therefore only suitable for the manufacture of modular plates, shaped elements, or paper.

Also, combustible spherical fiber aggregates, known from French Patent FR 898,980, are constructed of interlocked fibers, and therefore do not have any properties which are suitable for any use other than a combustible material.

In known textile materials, so-called textile connecting materials or non-wovens, there exists a uniform distribution of the fibers of the loosened fiber material, as well as a desired cohesion of the fiber layer, which creates favorable circumstances for connecting the fibers to the fiber layer, for example, by needle processing, such as needle punching, stitching, knitting, or the like. Known textile materials therefore have a uniform surface, and the fiber orientation corresponds to the desired anisotropic properties of the completed materials (see, for example, R. Krčma, Non-woven textiles SNTL Publishers of Technical Literature, Prague 1962, in co-edition with Textile Trade Press Manchester, 1967, page 43 or R. Krčma, Handbuch der Textilverbundstoffe, Deutscher Fachverlag GmbH. Frankfurt/M., page 167, 1970). Although a fibrous layer may be built up, for example, of fibrous flocks, because of its resultant substantially flat cross-section, it does not provide an adequately pronounced embossment pattern on the surface of the fibrous layer. The known textile materials of the aforedescribed kind are therefore processed, or flattened, according to specific desired properties, for example, so as to obtain a specific desired visual property, or a technically non-uniform shape.

If it is desired to obtain a structured surface, then fibers deposited in a plane can be raised perpendicularly to the plane, while a loop is formed by needles using a special process, or else the fibrous layer is structured in a special arrangement and shrinking of shrinkable fibers (for example, as taught in Swiss Patent No. 529,247) may be used.

Furthermore, colored effects can be obtained, as is known, by the use of colored fiber flocks, by mixing fiber naps or textiles of different colors, by using a needle process, such as stitching, knitting and the like, to attach a differently colored fibrous layer to the material. Although products manufactured in this manner show certain advantages with respect to needle-processed felts manufactured by different methods, their manufacture, as described above is, nevertheless, such more costly. Furthermore, such materials have the typical disadvantageous features of needle-processed felts, so that they do not feel sufficiently comfortable, when used as a floor covering, for example, due to a high density of fibers. For this reason, some needle-processed felts are hardly being considered for use as a cloth, or as blankets.

There are also known needle-processed carpets, in which yarns spun of wool are deposited in substantially parallel strands on a carrier, and are attached thereto by needle-processing; this attachment of the yarns to the carrier is subsequently reinforced by gluing the yarns to the carrier by binding means. Although the woolen fibers are bound to one another relatively well by the twisted and relatively thick yarns, so that less needle-processing than usual is required, and a relatively good thread structure remains, the high manufacturing cost, and the limitations, for example as far as thickness, color or pattern are concerned, are disadvantageous. In particular, any irregularity or uneveness between the parallel groups of yarns is immediately visible in such a merchandise. Yarns of this type cannot therefore, of course, be mixed, for example, with other loose fibrous layers, so as to obtain a desired pattern.

SUMMARY OF THE INVENTION

It is therefore one of the principal objects of the invention to devise a fiber aggregate of the aforedescribed kind, which does not have the disadvantages of known fiber aggregates, and which has a structure in which the individual fibers, inspite of being intermingled, are nevertheless distributed at a relatively low density; this permits a movement of the fibers through the fiber aggregates, while providing adequate cohesion of the fibers. The fiber aggregates should also have wide applicability or use, for example, in textile materials.

This object is attained, according to the invention, by providing a fiber aggregate composed of a multiplicity of substantially spherically intermingled fibers at a needle-processing density, the fiber aggregate having a diameter of at least 3 mm, each fiber having a length of at least 15 mm, and being free from being felted and intertwined with any other fiber.

Further objects and advantages of the invention will be set forth in part in the following specification, and in part will be obvious therefrom without being specifically referred to, the same being realized and attained as pointed out in the claims hereof.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
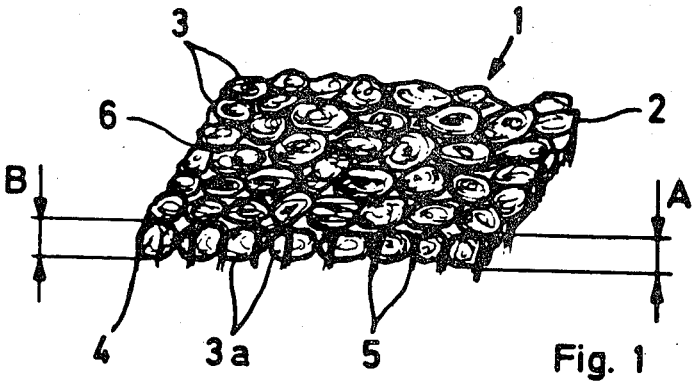
FIG. 1 is a perspective view of a textile material in section, according to the invention.

In carrying the invention into effect, a textile material 1 includes, according to FIG. 1, a non-woven fibrous layer 2, which contains individual fiber aggregates 3. Each fiber aggregate 3 is composed of fibers 4, which are substantially spherically intermingled, or rolled into one another, for example in the form of a skein. The fibrous layer 2 is composed of the fiber aggregates 3, which are substantially round ball-shaped yarns 3*a* initially separated from one another. The substantially ball-shaped yarns 3*a*, and consequently the fibrous layer 2 are, during the manufacture of the textile materials, connected to one another, for example, by needle processing, of fiber pieces 5, which form part of the fibers 4 of each fiber aggregate or ball yarn 3*a*. The fibers 4 may therefore be used and gripped by needles, which are commonly used to stitch materials together in textile technology, such as by felt needle-processing, without encountering any substantial resistance, and without the needles substantially destroying the fibrous layer, or being subjected to any undue wear and tear. The needles are preferably moved in a direction transverse, or at an angle to, the plane of the fibrous layer 2, and pass through the fiber aggregates, or ball-shaped yarns 3*a*. As can be seen from FIG. 1, the textile material 1 consists of a fibrous layer 2 composed of the ball-shaped yarns 3*a*; the ball-shaped yarns 3*a* preferably have a regular shape and are of similar dimensions, so that the fibrous layer 2 has a predetermined depth A, which is equal to the prearranged depth or diameter B of each ball-shaped yarn 3*a*. The ball-shaped yarns 3*a* can, however, also be interconnected by other appropriate needle-processing techniques, for example, by the Maliwatt-, the Malimo- or the Malipole processes. As a result of the use of ball-shaped yarns 3*a*, the textile material 1 has an irregular, for example, knub-like structured surface 6. If required or desired, the connection of the fibrous layers 2, to any projecting fiber end pieces 5, can be further reinforced by (non-illustrated) binding means.

Figure 2:
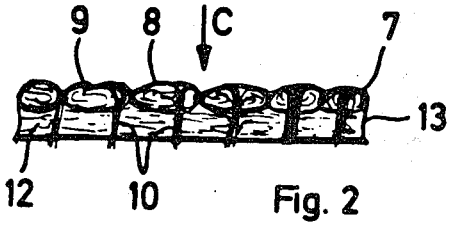
FIG. 2 is an elevational section of a textile material, including a carrier layer.
Figure 3:
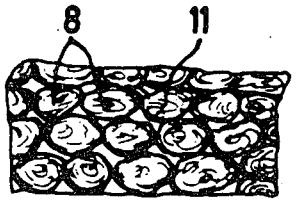
FIG. 3 is a plan view of a portion of the textile material, as seen along the arrow C of FIG. 2.

As shown in FIGS. 2 and 3, there is shown a non-woven fibrous layer 7 composed of substantially ball-shaped yarns 8, which contain substantially spherically intermingled fibers 9; the non-woven fibrous layer 7 has therefore an irregular, for example, structured surface 11. By means of needle-processed fiber pieces 10, which may be part of the ball-shaped yarns 8, the fibrous layer 7 is connected to a carrier 12, for example made of fleece, so that a textile material 13 is obtained.

Figure 4:
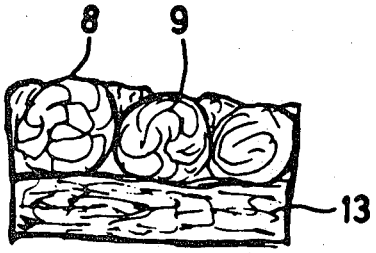
FIG. 4 is a sectional elevation view of a detail of FIG. 2, prior to connecting the fiber aggregates to one another and to the carrier.

As shown in FIG. 4, the ball-shaped yarns 8 have, when they are deposited, for example, on a carrier, a substantially round shape, before they are connected to one another, for example, by needle-processing. As a result of being connected to one another, the previously round ball-shaped yarns 3*a* are flattened, into substantially ellipsoid-shaped ball-shaped yarns 8, as shown in FIG. 2, and the flattening depends for example, on the strength or adhesive quality of the needle-established connections, or on the fluffiness or bulkiness of the ball-shaped yarns 3*a*. As a result of the needle-processing, the textile material may also be constricted as desired, so that an original structure can be obtained, such as is now, for example, possible using substantially two-dimensional fibers disposed essentially in a plane.

Figure 5:
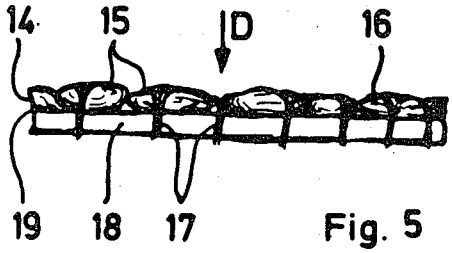
FIG. 5 is a sectional elevation view of another textile material, including a carrier.
Figure 6:
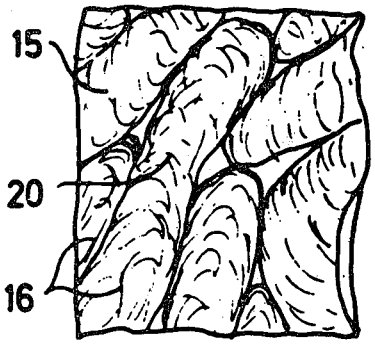
FIG. 6 is a plan view of a portion of the textile material shown in FIG. 5, as viewed along the narrow D of FIG. 5.

According to FIGS. 5 and 6, a non-woven fibrous layer 14 is composed of worm-shaped fiber aggregates 15 of different respective sizes, and each fiber aggregate 15 has fibers which are substantially spherically intermingled. The fiber aggregates 15 are attached through fiber pieces 17 to a carrier 18, for example, by means of needle-processing, and the fiber aggregates 15 and the carrier 18 together then form the textile material 19. As a result of the varying sizes and shapes of the fiber aggregates 15, there is obtained an irregular surface 20, which has a unique embossment structure.

Figure 7:
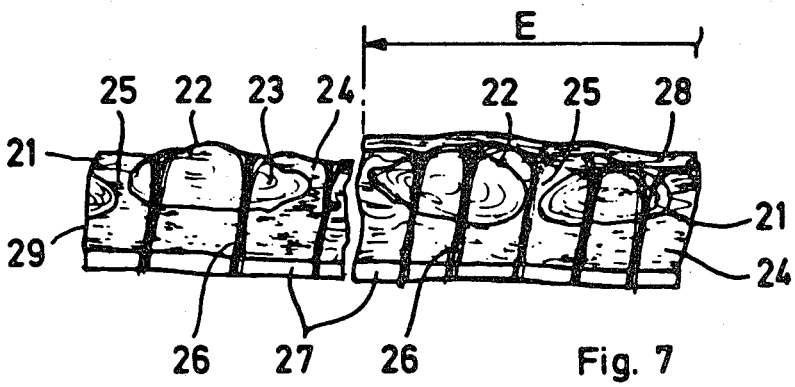
FIG. 7 is a sectional elevation view of a modified textile material.

A fibrous layer 21, according to FIG. 7, is composed of distributed fiber aggregates 22 of substantially spherically intermingled fibers 23. The fiber aggregates 22 are embedded in a fibrous material 24, which fills the spaces 25 between the fiber aggregates 22, and forms together therewith the fibrous layer 21. The fiber aggregates 22 and the fibrous material 24, are connected, through fiber pieces 26, to a carrier 27, for example, by needle-processing. The fibrous layer 21, composed of the fiber aggregates 22, the fiber material 24, and the covering layer 28, together with the carrier 27, form a textile material 29, which has, for example, a patterned surface.

Figure 8:
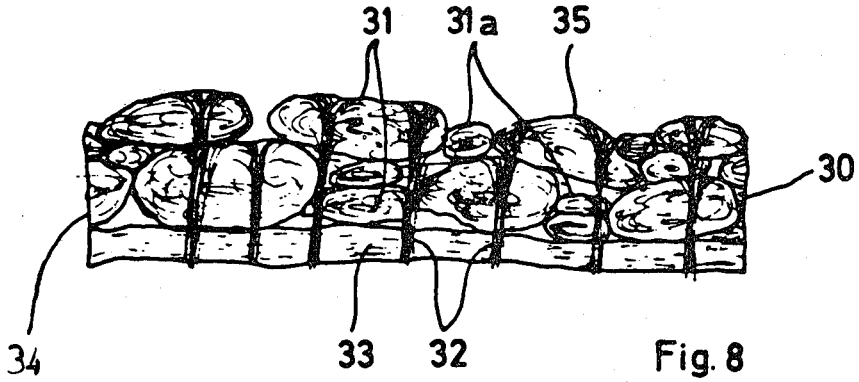
FIG. 8 is an sectional elevation view of another modified textile material.

As is shown in FIG. 8, a fibrous layer 30 is composed of fiber aggregates 31 and 31*a* of different respective sizes, which are connected by needle-processing through fiber pieces 32 to a carrier 33. A textile material 34 is obtained, which has a distinct embossment surface 35.

As has already been mentioned, the ball-shaped yarns may also be mixed with some other material or fibers, for example, felt material, coconut fibers, lamb fibers, felt pieces or the like, or may themselves be composed of a mixture of natural or synthetic fibers. They can be used in carpets, needle-processed felts, or the like.

It is also possible to use shrinkable fibers in the fiber aggregate, for example, the ball-shaped yarn 31 or 31*a*, so that during the shrinkage either the fiber aggregate may shrink with respect to another fiber aggregate, or the fiber aggregate may shrink with respect to a support, such as the carrier 33. This does not cause, for example, the appearance of any sudden change in the width of the material, as shrinkage does not take place across the width of the material, as a result of using fiber aggregates, or ball-shaped yarns.

Figure 9:
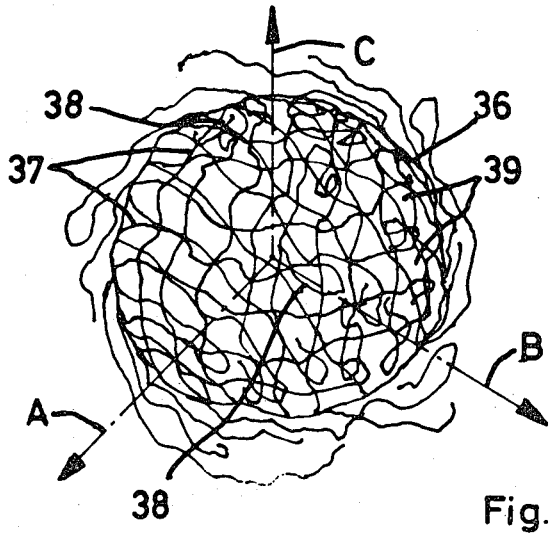
FIG. 9 is a sectional view of a single finger aggregate of the textile material.

FIG. 9 shows how a ball-shaped yarn 36 is built-up from individual fibers 37, which are substantially spherically intermingled. The fibers 37 are intermingled loosely, so that their ends 38 are also loosely intermingled with other fibers or yarns 37, or rolled thereround in a substantially spherical manner, so that the fibers 37 are maintained within the fiber formation. The substantially spherical orientation of the fibers or yarns can be recognized from the substantially spherical shape of the ball-shaped yarn 36 in the spatial dimensions along the arrows A, B and C.

The fibers 37 are disposed within the ball-shaped yarn 36 loosely, and are not interlocked felted or intertwined with other fibers; air spaces 39 are therefore formed between the fibers 37, which have dimensions which substantially exceed the thickness of the fibers 37 themselves. The fibers 37 are thus substantially separated from one another, have a length of at least 15 mm, and make contact with one another only because they are loosely intermingled. One therefore obtains a structure of loosely intermingled fibers 37, so that each fiber 37 can be individually gripped without offering any substantial resistance, and without there occurring any disintegration of the ball-shaped yarn 36, so that the fibers 37 can be individually withdrawn therefrom. The ball-shaped yarn 36 has therefore a low needle-processable density and, for example, a fluffiness of a type so that it can be squeezed together wwithout the exertion of any significant force thereon. As a result of the spherically intermingled fibers 37, the ball-shaped yarn 36 has an elasticity or springiness which extends in three dimensions, so that it can substantially resume its original shape, after a stress exerted thereon has been removed. Such a springiness cannot be obtained, for example, in fibers which are disposed substantially in a plane along only two dimensions, or in the case of twisted fibers or yarns, which lie closely to one another, as a result of a twist being imparted thereon, and therefore have a homogeneous density. With respect to conventional yarns, one obtains a mechanical cohesiveness between fibers, which is exclusively the result of the substantially spherical intermingling of the fibers, or the substantially spherical rolling up of these fibers; this method of intermingling furthermore prevents a dissolution of the ball-shaped yarn 36. This cohesiveness can be increased further, for example, by the use of curled fibers, for example, by using a percentage of about 40% of polypropylene fibers.

The fiber aggregates composed of substantially spherically intertwined fibers, as used in textile materials, according to the invention, have, for example, totally different properties compared to the aforedescribed known hard textile materials, which are composed of interlocked fibers, and which, due to their high density and their short fiber length of about 3 mm, cannot be penetrated, gripped or processed by needles.

The ball-shaped yarn can therefore be penetrated, as a result of its needle-processable density, by needles throughout its entire width without disintegrating or falling apart, by the fibers 37, as a result of their length of at least 15 mm, being gripped, and passed through the ball-shaped yarn 36.

Furthermore, a needle may pull a length of fiber, or a bundle of fibers, so that the pulled length extends out of the aggregate, without losing its cohesion with the aggregate.

The ball-shaped yarns of the textile material, according to the invention, are not comparable with a burl or a knub, which as is known, consists of a randomly intwined mass of fibers tied together to form a nodule or knot (P. Böttcher, Textiltechnik, VEB Fachbuchverlag, Leipzig, 1970, pages 750 and 758). They are therefore also hard formations composed of interlocked fibers, at a high density, and do not have a needle-processable density, as does the ball-shaped yarn, according to the invention. A nodule or knot is furthermore an undesired defective product of a size smaller than about 3 mm, for which reason such a nodule or knot cannot be processed by needles, and furthermore contains, for example, only about 10 individual fibers or yarns. The ball-shaped yarn of the present invention, however, is composed, for example, of many more than about 10 individual fibers or yarns, and therefore represents a desired end product, which is rollable, unlike conventional yarns, nodules or knots.

The ball-shaped yarn, such as, for example, the ball-shaped yarn 3*a*, prior to its usage in a textile material, may be strengthened, or be made more cohesive, separately. For this purpose, the natural interlocking capability of woolen fibers can be made use of, as a result of which the ball-shaped yarn can be strengthened further, beyond the cohesiveness due solely to the spherical intermingling of the fibers, while still retaining a needle-processable density. The ball-shaped yarn may, however, also be impregnated, or treated by binding means. The loose structure provides an advantage, as the surface of the individual fibers may be reached by the binding means, so that the binding means can fully penetrate into the ball-shaped yarns; this also applies to coloring means. In the case of knots or nodules, or even in the case of twisted yarns, the surface of the individual fibers is, however, blocked by adjacent fibers, so that it cannot be reached in the same manner as in the ball-shaped yarns.

Table 1 below shows typical parameters as function of the yarn as material.

TABLE 1

| | PP* | Wool | PP/Wool |
|---|---|---|---|
| Diameter of ball-shaped yarn | 5–15 mm | 5–10 mm | 5–15 mm |

TABLE 1-continued

| | PP* | Wool | PP/Wool |
|---|---|---|---|
| Length of stack | 90 mm | 60 mm | 60/90 mm |
| dtex | 17 | 3–45 | 17/3–45 |
| Stitch density per $cm^2$ | 100 | 64 | 126 |
| Stitch depth in mm | 20 | 25 | 20 |
| Needle Number | 30 | 30 | 30 |

*PP = Polypropylene

The conditions for use are, for example, only a single parameter in a series of conditions, which, for example, are determined by the qualitative requirement for the ball-shaped yarns, or for the textile material. The needle-processing densities, or stitchable densities, can be maintained equal for different sized and fiber types of the ball-shaped yarn; but it is also possible to reduce the needle-processing or stitchable density by about 25% to 50%, if this is advantageous, for example, as far as the size of the ball-shaped yarn, type of fiber, or the like is concerned, because a certain entanglement of the fibers by spherical intermingling in the ball-shaped yarn has already taken place prior to stitching. The ball diameter, namely the size of the ball-shaped yarn is, for example, independent of the fiber length. Thus, it is possible to manufacture ball-shaped yarns, which use the same fiber length, which have a diameter of 4 mm, and also ball-shaped yarns which have a diameter of 25 mm. The size of the ball-shaped yarns can furthermore be dependent on the diameter or thickness of the fiber, any curling of the fiber used, or the E-module of the fiber.

As a result of the rolling capability of the ball-shaped yarns, a multiplicity of ball-shaped yarns, such as ball-shaped yarns 3*a*, 8, 15, 22, 31, or 31*a*, can be distributed arbitrarily, for example, unordered or at random, as a single layer, such as, for example, the layer 7, or as several layers, one above the other. It is therefore possible to devise a fibrous layer with a corresponding surface embossment structure, and to create a special, for example, visual effect. But, it is alternately possible to arrange, for example, for an ordered deposition of a multiplicity of ball-shaped yarns, such as for example ball-shaped yarns 31 or 31*a*, in a desired and predetermined pattern, in rows, in squares, and the like. By an ordered deposition, the fiber material available in the shape of the ball-shaped yarns may be arranged, for example, for needle-processing, in a surprising manner. The fiber material may therefore be deposited on a desired location of the fiber layer to be manufactured, and may be appropriately interconnected, or attached to a carrier. For example, an arrangement in parallel rows, such as using ball-shaped yarns offset with respect to another, can be attained, which has hitherto been only possible, if at all, at a correspondingly high expense.

Thus, it is possible, for example, to devise weblike structures. But it is also possible to first deposit a layer of ball-shaped yarns, for example ball-shaped yarns 3*a*, of a relatively large diameter, and to fill the gaps between the relatively large-diameter ball-shaped yarns with ball-shaped yarns of a relatively smaller diameter.

Summarizing then, and based on the recognition, that short fibers cannot be spherically intermingled due to their relatively short length, and may be only interlocked or disposed next to another so as to form a spherical fiber aggregate, the present invention proposes a fiber aggregate which has the aforedescribed properties. In contrast to the prior art, the ball-shaped yarn, such as, for example, the ball-shaped yarn 3*a*, according to the invention, is surprisingly structured, so that fibers which have an adequate length of at least 15 mm, substantially follow the curvature of the ball-shaped yarn, or are suitably oriented, so that they are spherically intermingled. Due to the inventive needle-processing density, the individual fibers are not only individually accessible, but are disposed, for example, in an adequately loose aggregate, or arrangement. They may be individually gripped, for example, by needles, as they are known in the needle processing art, and may be substantially moved without offering any resistance with respect to other fibers in the fiber aggregate of the ball-shaped yarns, and may be withdrawn therefrom, that means, may be actively needle-processed. The ball-shaped yarn, for example the ball-shaped yarn 3*a*, may, however, also be passively needle-processed, namely fibers or yarns can be passed therethrough, or pulled therethrough, or fed thereinto. The spherical intermingling of the fibers in the ball-shaped yarn ensures, however, a consistency, which permits the handling of the same without any disintegration of the ball-shaped yarn. This is due to the intermingled arrangement of the fibers in the ball-shaped yarn, so that, for example, a predetermined consistency of one yarn with respect to one another is obtained similarly, as for example, in conventional loosely twisted fiber yarns. As a result of the shape of the ball-shaped yarn, there is formed, for example, a close structure, or body which the predetermined or limited dimensions, and a surface, in which the fibers, particularly the respective fiber ends, are maintained in the interior of the ball-shaped yarn, and are therefore secured from falling out from the ball-shaped yarn.

In spite of the fact that the ball-shaped yarns are needle-processable, the ball-shaped yarns have a greater cohesion, for example, an improved tensile strength, and abrasive resistance, than a known and untwisted fiber aggregate, for example, a fiber flock, where the fiber flock contains fibers on its surface, which project therefrom, and are not secured against being pulled out.

The ball-shaped yarn, according to the invention, comprises, for example, individual fibers, namely individual fibers of a finite length, and its shape and the round cross-section arise due to the spherical intermingled arrangements of the fibers, which are, for example, spherically loosely intermingled or rolled up. The ball-shaped yarn may, however, also include spherically intermingled elements of helically intertwined and spun fibers, or strands, composed of individual fibers disposed parallel to one another.

As a result of their structure, the ball-shaped yarns, for example the ball-shaped yarns 3*a*, are preferably more or less rollable, in contrast to fibers, fiber bundles, or fiber flocks on one hand, and conventional yarns, on the other hand. The shape of these fiber aggregates, such as ball-shaped yarns 3*a*, may be either spherical or spheroidal, namely each may have a longitudinal or stretched shape, but in cross-section, may be preferably, round, for example, such as the yarn. At a width-to-length ratio of, for example, 1:1, the ball-shaped yarn is then substantially or completely round, while at a width-to-length ratio of, for example, 1:2, it is substantially shaped like an ellipsoid, and at a width-to-length ratio of, for example 1:3 up to 1:5, it is substantially worm-shaped. But, it may also be shaped substantially like a cylinder.

As a result of its rollability, the ball-shaped yarn, for example the ball-shaped yarn 3*a*, can be handled well when mixing ball-shaped yarns, and forming layers, so that they are ideally suitable for forming textile materials, as is described, for example in copending application entitled "Textile Material" which is incorporated into the present application by reference. Although the fibrous layer, for example, the fibrous layer 2, may be built up from fiber flocks, it is not possible to obtain an adequate embossment pattern on the surface of such a fiber layer due to its relatively flat cross-section. The known needle-processable textile materials are therefore limited according to requirements, for example, of obtaining visually, or optically interesting, or technically unevenly shaped surfaces.

Based on the recognition that twisted yarns, as a result of their initial cohesiveness, require, for example, less needle-processing than loose fibers, but result in a relatively costly product, which is difficult to count, and difficult to combine, it is possible to devise with the ball-shaped yarns, according to the invention, a textile material which has an irregular surface, can be patterned as desired, for example, by structuring it in a nodule-like manner, or coloring it with different colors, and using different fibers therein.

The ball-shaped yarn, which is composed of the individual fibers which are not intertwined with one another, can therefore be used in a non-woven and appropriately reinforced fibrous layer of a textile material, which is reinforced, for example by connecting fibers, which may be part of the strands of the ball-shaped yarn itself.

Connecting fibers include not only those fibers conventionally used in needle-processing techniques in non-wovens, for example, fleeces or textile-connecting materials, but also those used when knitting, crocheting or the like; they may be, for example, actively or passively needle-processable, so that the ball-shaped yarns may also be available in a crocheted or knitted fiber aggregate, and be correspondingly reinforced, or made more cohesive. But the ball-shaped yarn may be also stitched or sewn, for example, in a multi-needle process, so that, for example, fibers, or sewing or stitching threads, are also included in the term "connecting fibers".

Depending on the desired pattern and/or shape of the ball-shaped yarns, these may comprise between 10% to 100% of the total weight of the fibrous layer.

Depending on the type of fibers and/or quantity of fibers used, or the desired pattern, the round ball-shaped yarns may have a diameter from about 3 mm to about 50 mm. The worm-shaped fiber aggregates may have a thickness from about 3 mm to about 50 mm, and a length, for example, from about 9 mm to 150 mm. The size or width of the individual ball-shaped yarn depends, inter alia, for example, apart from the thickness of the fibers, on the type of the fibers, and the length and quantity of the intermingled fibers. In the unconnected state, the fiber density in a loose and deposited ball-shaped yarn may have a value from about 0.01 grams per cubic centimeter, to about 0.1 grams per cubic centimeter.

The textile materials therefore have preferably novel properties which depend, for example, on the type, density and interconnection of the ball-shaped yarns, for example, ball-shaped yarns 3*a*. The ball-shaped yarns may have similar or different consistencies. Each ball-shaped yarn, for example, ball-shaped yarn 3*a*, may contain only one type of fiber, or mixtures of fibers, or may have one or several colors. In an advantageous manner, the fibers, such as, for example, the fibers 41 of the ball-shaped yarns, may have different lengths, and thus be composed of relatively short fibers, or may contain fibers of, for example, waste yarns, namely yarns of differing manufacture and different colors. These can be natural fibers, such as, for example, cotton or woolen fibers, or animal fibers, such as lamb fibers, fur fibers, or the like, or synthetic fibers of various types, for example, one or several multifilaments, such, as for example, those composed of polyamide, polypropylene, polyesther, glass fibers or the like; textured, or for example, curved fibers provide an additional structure and/or fluffliness. It is also possible to use a mix of ball-shaped yarns composed of natural fibers, on one hand, and of synthetic fibers, on the other hand. The length of the stacks or staple fibers can be chosen arbitrarily within the scope of the manufacture, and may range from about, for example, 40 mm to about 120 mm. The titer of the fibers may range from about 3 dtex to about 100 dtex, and lie preferably between 6 and 40 dtex; it is advantageous, for example, to admix a certain percentage of coarse fibers for a desired structure.

In an advantageous fashion, a ball-shaped yarn, such as the ball-shaped yarn 3*a*, may lie next to another ball-shaped yarn. Thus, a single-layer aggregate, and consequently a single-layered textile material may be formed, which has a depth, for example, corresponding to the thickness of the ball-shaped yarns following needle-processing. But it is also possible also to employ alternately superimposed ball-shaped yarns, so that a correspondingly thicker fibrous layer is formed, and the ball-shaped yarns, such as the ball-shaped yarns 31 and 31*a*, may have differing sizes and diameters, and it is also possible, for example to mix different ball-shaped yarns with one another. The fibrous layer, such as, for example, the fibrous layer 21, may be composed of a plurality of ball-shaped yarns of a relative large diameter, and a layer of ball-shaped yarns of relatively smaller diameters superimposed thereto; both layers can then be interconnected by needle processing or the like.

In a further embodiment of the invention, the ball-shaped yarns in the fibrous layer may also be composed of fibrous material, for example, of the aforedescribed consistency used for the ball-shaped yarns; but they may have a different shape or form, by using, for example, longitudinal fiber elements, fiber flocks, or a mixture of fibers. Alternatively, the ball-shaped yarns may be embedded in the fibrous layers, if this is desired, for example, for improving the interconnection or consistency of the material, the pattern, or filling of any spaces or gaps between the ball-shaped yarns. A mixture of ball-shaped yarns with a fibrous material of different consistency can be advantageous, for example, if a textile material, according to the invention, is used for outer garments.

The fibrous layer, including the fiber aggregates, may, however, also be attached to a carrier, for example, by needle processing, such as stitching, so that the ball-shaped yarns also become attached to the carrier.

The ball-shaped yarns may, in particular, however, also be loosely deposited on the carrier, and attached thereto by needle processing, such as stitching, or the like. The carrier may be a passively needle-processable material, as has been previously defined, such as a sheet of synthetic material, a screen, a mesh, a web, a cloth, a fibrous connecting material, paper, cotton, or the like.

In a further modified version, the carrier may also be an actively needle-processable material, as previously defined, so that the textile material may be additionally needle-attached to the carrier, for example, by stitching the textile material to the carrier from the carrier side. It is furthermore also possible to superimpose and attach a covering layer of a material of different shape or form than the ball-shaped yarns themselves to the fibrous layer. This covering layer may, for example, be composed of textile fibers, or may have a non-textile consistency or composition, such as, for example, of the type used in the carrier, and may be needle-attached to the carrier and/or ball-shaped yarns. The use of a covering layer, for example, the covering layer 28, may prevent any damage due to too strong an active needle-processing, such as stitching of previously reinforced ball-shaped yarns. Any risk of damaging the ball-shaped yarns may, however, also be avoided by the aforedescribed mixing of the ball-shaped yarns with a fibrous material of different consistency.

The fibrous layer preferably contains the ball-shaped yarns over the entire extent of the textile material; but the ball-shaped yarns may be disposed only on a portion of the textile material, according to a desired pattern. In this manner, textile patterns of any desired structure, any desired consistency, and any desired visual pattern or, for example, any desired aesthetic design, can be created. The textile material, according to the invention, can be used as a textile cloth, for example, a wall covering, a floor covering, a blanket, a garment, as a decorative material, or as an upholstery material, for example, for upholstering padded furniture, but also as an insulating material. The ball-shaped yarns may also be fabricated, for example, by intermingling or rolling up of fibers between fingers of a hand, so as to form the fibers into balls, or into longitudinal shapes; thus it is possible, for example, to devise web-like structures.

Technical manufacturing methods for spherical fiber aggregates are known, for example, from the already mentioned German Patent DE-OS 28 11 004.

I wish it to be understood that I do not desire to be limited to the exact details of construction shown and described, for obvious modifications will occur to a person skilled in the art.

Having described the invention, what I claim as new and desire to be secured by Letters Patent is as follows:

1. A fiber aggregate being unconnected to any other fiber aggregate prior to needle processing and having a smallest diameter of 3 mm. and comprising fibers, each fiber having a length of at least 15 mm., at least some of said fibers being intertwined to form a body of a substantially spherical to an elongate shape, and said body having a density ranging from about 0.01 to about 0.1 grams per cubic centimeter, the intertwining being such that a needle commonly used in needle processing technology to stitch materials together may penetrate said body and grip and withdraw any fiber from said body free from encountering any substantial resistance so that the pulled length would extend out of the body without losing its cohesion with the body.

2. A fiber aggregate, as claimed in claim 1, wherein each fiber has a length from about 40 mm to about 120 mm.

3. A fiber aggregate, as claimed in claim 1, wherein said body has a width of up to about 50 mm.

4. A fiber aggregate, as claimed in claim 1, wherein said body is substantially ellipsoid-shaped.

5. A fiber aggregate, as claimed in claim 1, wherein said ellipsoid shape has a width-to-length ratio of about 1:2.

6. A fiber aggregate, as claimed in claim 1, wherein said body is elongated and has a width-to-length ratio from about 1:3 to about 1:5.

7. A fiber aggregate, as claimed in claim 1, wherein each fiber includes a plurality of helically intertwined fiber elements.

8. A fiber aggregate, as claimed in claim 1, wherein said fibers are natural fibers.

9. A fiber aggregate, as claimed in claim 1, wherein said fibers are synthetic fibers.

10. A fiber aggregate, as claimed in claim 1, wherein said fibers include natural and synthetic fibers.

11. A fiber aggregate, as claimed in claim 1, further comprising binding means for impregnating and binding at least some of said fibers together.

12. A fiber aggregate, as claimed in claim 1, wherein at least some of said fibers are shrinkable.

13. A fiber aggregate as claimed in claim 1, wherein at least some of said fibers are curled fibers.

* * * * *